US007096605B1

(12) United States Patent
Kozo et al.

(10) Patent No.: US 7,096,605 B1
(45) Date of Patent: Aug. 29, 2006

(54) ARTICLE OF FOOTWEAR HAVING AN EMBEDDED PLATE STRUCTURE

(75) Inventors: Maria J. Kozo, Portland, OR (US); Susanne Wolf-Hochdoerffer, Portland, OR (US)

(73) Assignee: Nike, Inc., Beaverton, OR (US)

( * ) Notice: Subject to any disclaimer, the term of this patent is extended or adjusted under 35 U.S.C. 154(b) by 56 days.

(21) Appl. No.: 10/680,410

(22) Filed: Oct. 8, 2003

(51) Int. Cl.
*A43B 13/12* (2006.01)

(52) U.S. Cl. ..... 36/103; 36/108; 36/76 R; 36/30 R; 36/3 B

(58) Field of Classification Search ..... 36/103, 36/107, 108, 76 R, 73, 167, 171, 175, 177, 36/30 R, 3 B
See application file for complete search history.

(56) References Cited

U.S. PATENT DOCUMENTS 1,387,411 A * 8/1921 Kolkebeck ..... 36/76 R
4,439,937 A * 4/1984 Daswick ..... 36/107
5,528,842 A 6/1996 Ricci et al.
5,647,145 A * 7/1997 Russell et al. ..... 36/28
5,720,117 A * 2/1998 Toschi ..... 36/76 R
6,041,525 A 3/2000 Kelley
6,108,943 A 8/2000 Hudson et al.
6,393,732 B1 * 5/2002 Kita ..... 36/30 R
6,477,791 B1 * 11/2002 Luthi et al. ..... 36/31
6,775,930 B1 * 8/2004 Fuerst ..... 36/103

OTHER PUBLICATIONS

One photo of an assembled shoe with outsole and one photo of the shoe with an unassembled outsole to shown a midsole construction; the sole released at least one year prior to the filing date of the instant application.

* cited by examiner

*Primary Examiner*—Ted Kavanaugh
(74) *Attorney, Agent, or Firm*—Banner & Witcoff, Ltd.

(57) ABSTRACT

An article of footwear includes a sole with a midsole. A midsole plate includes a lateral fork member and a medial fork member configured to provide flexibility to the phalanges bones during ground engaging actions. The midsole plate includes a plurality of perforations configured for air communication within an upper of an article of footwear. A midsole plate may include a phalanx portion, a metatarsal portion and a midfoot portion corresponding to a foot of a wearer. The phalanx portion, the metatarsal portion, and the midfoot portion each have a different stiffness with respect to each other.

9 Claims, 9 Drawing Sheets

ARTICLE OF FOOTWEAR HAVING AN EMBEDDED PLATE STRUCTURE

FIELD OF THE INVENTION

The present invention generally relates to an article of footwear. More specifically, the invention relates to an article of footwear having an embedded plate structure designed to enhance cycling and ground engaging activities.

BACKGROUND OF THE INVENTION

Numerous consumers and athletes purchase footwear for use in athletic activities such as running, cycling, cross training, soccer, football, baseball, tennis, walking, and the like. The shoes worn by the athlete can effect the performance and contribute to their overall success in an athlete event.

A shoe that is configured for one athletic activity, such as long-distance running, may not be suitable for use during another athletic activity, such as cycling. Likewise, a conventional shoe for cycling is undesirable of running activities. Conventional athletic footwear has certain drawbacks in design and function. A dilemma related to cycling footwear is the difficulty in finding an ideal balance of various factors for performance purposes to support other sporting events. In one balancing factor, the shoe should perform well under the high impact loading to withstand stress and strain on various portions of the shoe. Another factor to balance includes providing a shoe that is rigid for support, while being lightweight and somewhat flexible for performance purposes, such as running activities. Another drawback of conventional cycling shoes involves an outsole plate, which severally limits running performance. In particular, conventional cycling shoes, when used for walking or running activities, inhibits the musculo-skeletal motion with respect to the flexibility movement of the phalanges bones and the metatarsal bones of a wearer's foot. This interference can cause discomfort, fatigue, and injury. It is desirable to eliminate interference with the biomechanical running sequence, but to enhance performance by providing a shoe with that can be used for running activities as well as cycling.

Spinning is fast becoming a popular cycling training activities in the health and fitness industry. Participants exercise on a stationary bicycle through a series of intensive aerobic action. The problems of conventional shoes are magnified during activities performed in a gym, such as spinning, aerobic exercise, or treadmill work. If a wearer is using a conventional cycling shoe for performing spinning activities, the wearer must switch to different footwear for aerobic exercise or treadmill work, and as a result waste time. Otherwise, if the wearer keeps on the cycling shoe, the wearer has a difficult time and can be vexed with using the cycling shoe for the noted types of athletic activities. The conventional cycling shoe does not support these activities.

In view of the foregoing, there is also a need for an article of footwear that overcomes deficiencies of certain athletic shoes, including, but not limited to deficiencies found in conventional shoes intended for the sport of indoor or outdoor cycling and running.

SUMMARY OF THE INVENTION

The present invention pertains to an improved article of footwear that overcomes the deficiencies in certain athletic shoes including cycling shoes, which can be effectively used for other sports.

In one aspect, an article of footwear includes an upper for holding a foot of a wearer and sole including an outsole for engaging a ground surface, and a midsole portion attached to the outsole. The midsole portion includes a resilient material and a midsole plate being coupled to the resilient material. The midsole plate has a two laterally disposed tines corresponding to a forefoot of a wearer when superimposed thereon in which the tines define a forked geometry. In this manner, an aspect of the present invention facilitates the musculo-skeletal motion with respect to the flexibility movement of the phalanges bones and additionally the metatarsal bones of a foot of a wearer.

In one aspect, an article of footwear includes an upper for holding a foot of a wearer and a sole attached to the upper. The sole includes a midsole having a midsole plate; the midsole plate includes a lateral fork member and a medial fork member, the lateral fork member and medial fork member being configured to provide flexibility to the phalanges bones during ground engaging actions. Thus, an aspect of the present invention eliminates interference with the biomechanical running sequence, and enhances performance by providing a shoe with that can be effectively used for running activities as well as cycling.

In another aspect, an article of footwear includes a midsole plate which includes a phalanx portion, a metatarsal portion and a midfoot portion corresponding to a foot of a wearer. The phalanx portion, the metatarsal portion, and the midfoot portion each have a different stiffness with respect to each other. In a further aspect, the midsole plate includes a lateral fork member and a medial fork member which have a stiffness which is less than the stiffness of the metatarsal portion or the midfoot portion. Thus, a regional stiffness configuration enables a midsole plate to function in specific locations to facilitate ground engaging action and cycling with the same shoe.

In another aspect, an article of footwear includes an upper for holding a foot of a wearer; and a sole attached to the upper. The sole includes a means for the foot of a wearer to apply a pedaling force generally perpendicular to a pedal of a bicycle during a down stroke. The sole includes a means for independent heel-to-toe flexing of a plurality of phalanges bones of the foot of a wearer during a foot strike of a ground surface.

These and other aspects, features and advantages of the present invention will be readily apparent and fully understood from the following detailed description of preferred embodiments, taken in connection with the appended drawings, which are included by way of example and not by way of limitation with regard to the claimed invention, in which like reference numerals identifying the elements throughout.

DETAILED DESCRIPTION OF THE PREFERRED EMBODIMENTS

Figure 1:
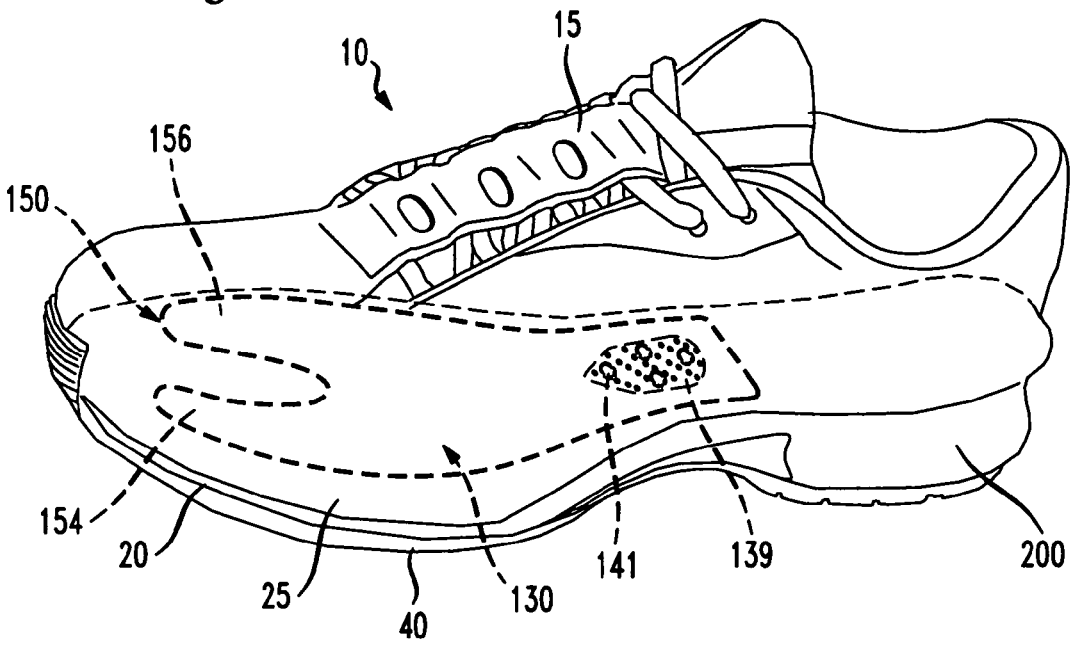
FIG. 1 is a perspective view of an article of footwear with a portion of the upper removed to reveal a midsole plate arrangement according to one or more aspects of the present invention.
Figure 2:
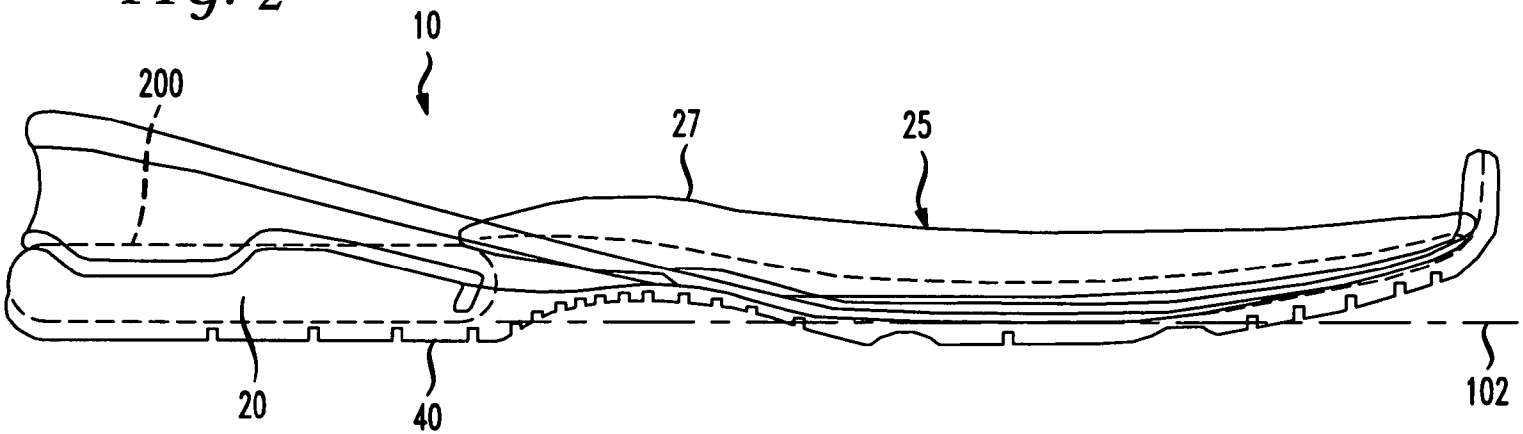
FIG. 2 is a schematic side elevational view of the lateral side of an article of footwear of the present invention with the upper removed for clarity.
Figure 3:
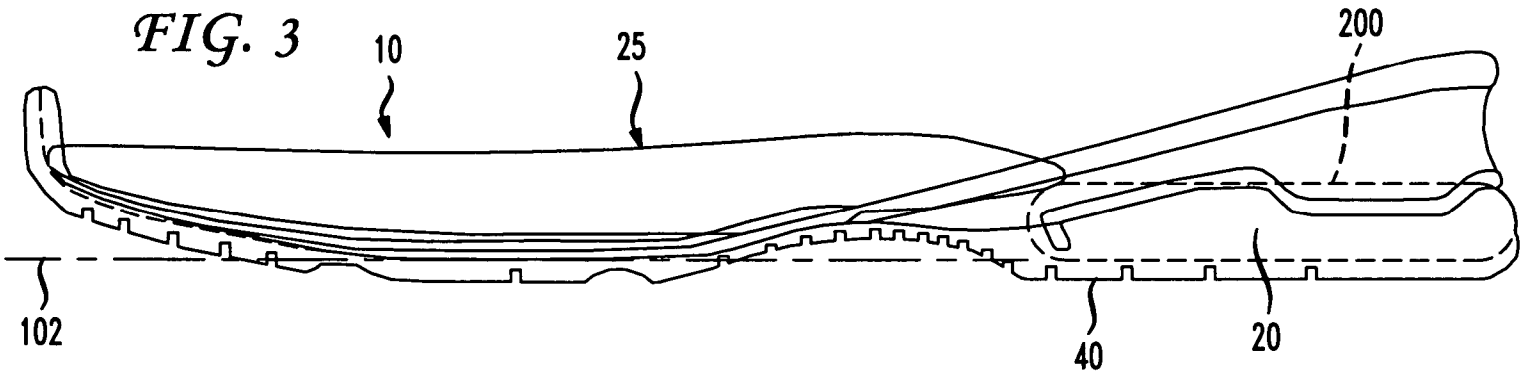
FIG. 3 is a schematic side elevational view of the medial side of an article of footwear of the present invention with the upper removed for clarity.

FIGS. 1–13 illustrate an article of footwear is generally referred to herein as a shoe 10. Shoe 10 may be preferably used to enhance performance in, and prevent injuries associated with, the sport of cycling and running. The aspects of the present invention advantageously applies features and structures to the forces applicable to the different areas of the shoe, in order to enhance flexibility, and support in the specific areas where needed for different sporting activities. This, in turn, provides improved performance and minimizes injuries for the wearer. In one construction, an embedded plate is recessed into the midsole footbed. The plate provides added rigidity characteristics that increase the energy efficiency of the footwear during cycling activity. While the plate offers added rigidity for cycling activity, it is configured such that a shoe remains suitable for running activity or other gym activities.

The inventive concepts relating to shoe 10, which are presented in the following discussion, may be applied to a wide range of other footwear styles that include athletic footwear. Further, the use of the term "cycling" relates to a stationary or a movable bicycle having at least pedals, which rotate about an axis. One skilled in the relevant art will recognize, therefore, that the concepts disclosed in the following discussion with respect to shoe 10 are not intended to be limited solely to footwear having the general configuration of a shoe with an enclosed upper, and may be applied to a wide range of other footwear styles.

Referring to FIGS. 1–13, shoe 10 includes two primary footwear elements, an upper 15 and a sole 20. A sole 20 has a forefoot enhancing performance, in which a midsole plate 130 allows for the flexibility movement of the phalanges bones and the metatarsal bones of a wearer's foot to facilitate locomotion on foot strike actions. This feature is achieved in-part by way of midsole plate 130 including a fork structure 150 which provides medial-to-lateral and lateral-to-medial flexibility for forward propulsion on foot strike action and heel-to-toe support during pedaling motion on a bicycle. Thus, midsole plate 130 eliminates the interference of the biomechanical running sequence of conventional cycling shoes. Additionally, midsole plate 130 further includes a metatarsal portion 137 for metatarsal bones of a foot of a wearer that provides a resilient return of energy to facilitate periods of running activity or other activities having a foot strike action. Advantageously, shoe 10 can function efficiently for several activities including, running, spinning, as well as most other exercise classes offered in a health club.

Figure 4:
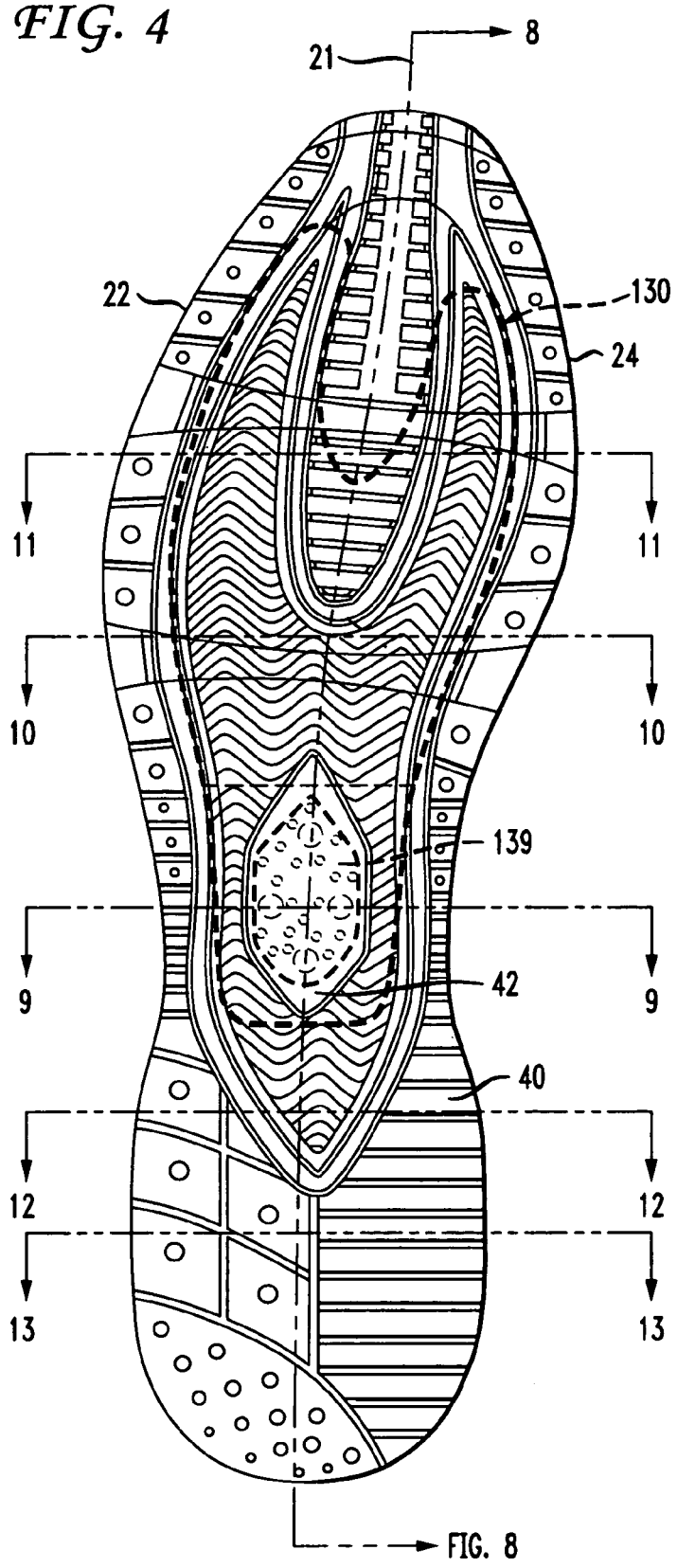
FIG. 4 is a schematic bottom plan view of the article of footwear of the present invention illustrating an outsole with a superimposition of a midsole plate arrangement according to one or more aspects of the present invention.

As shown in FIG. 4, sole 20 includes a lateral-medial dividing line 21, which is defined as a line generally formed by bisecting the midpoints between the front and rear of the sole 20 separating the two side-by-side regions of the sole. For ease of explanation regarding directions or orientation of components of the shoe 10, when the shoe 10 is worn, the lateral side 22 generally faces away from the centerline of a wearer's body. The medial side 24 generally faces inward towards the centerline of a wearer's body.

The upper 15 is secured to the sole 20 in any conventional manner and forms an interior space of the article of footwear 10 for securely and comfortably receiving a foot of a wearer. The upper 15 may be formed from multiple elements, but need not be, constructed of a material or a combination of materials thereof that are stitched and adhesively bonded together to form a comfortable structure for receiving the foot. The materials may be as polyester, or nylon. In a preferred construction, the upper materials may include a breathable mesh, synthetic leather, leather or other leather materials. Nonetheless, a conventional upper design may be implemented.

Sole 20 attenuates ground reaction forces and absorbs energy as the article of footwear 10 contacts the ground surface, and may incorporate multiple layers that are referred to as a midsole 25 and an outsole 40. The midsole 25 generally forms the middle layer of the sole 20. The outsole 40 forms the ground-contacting element of the article of footwear 10 and may be fashioned from a durable, wear resistant material that includes texturing to improve traction. The midsole 25 provides cushioning and support and is more compressible than outsole 40 to achieve a cushioning function. The midsole 25 may be primarily composed of resilient foam material, such as polyurethane (PU) open cell, PU closed cell, or a similar material or combination of material.

Figure 8:
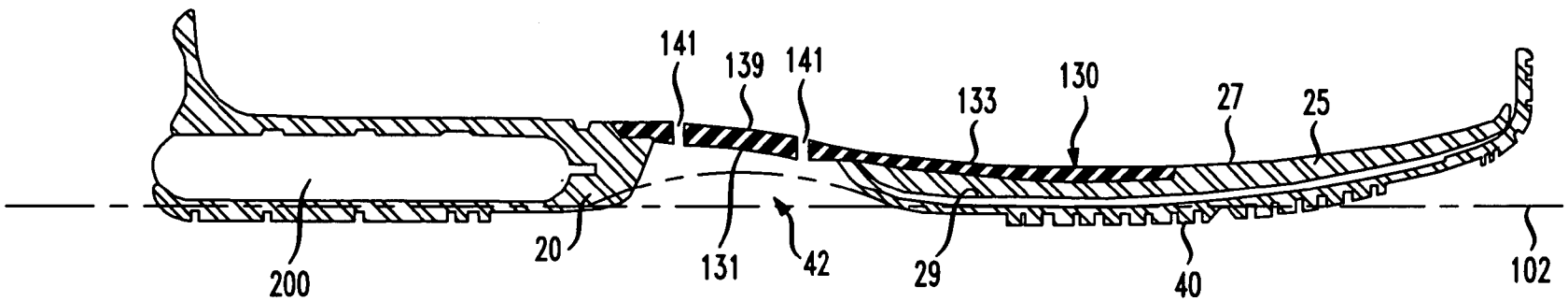
FIG. 8 is a section view of taken along line 8—8 of FIG. 4 illustrating a heel-to-toe arrangement of the sole of the present invention.
Figure 9:
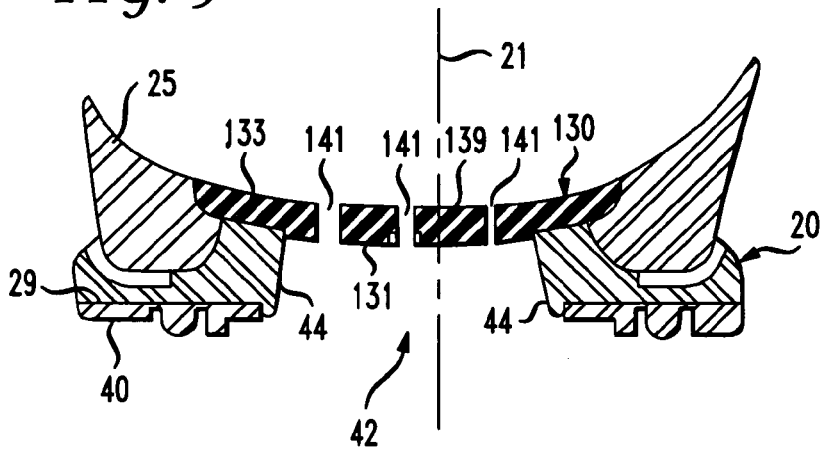
FIG. 9 is a section view of taken along line 9—9 of FIG. 4.
Figure 10:
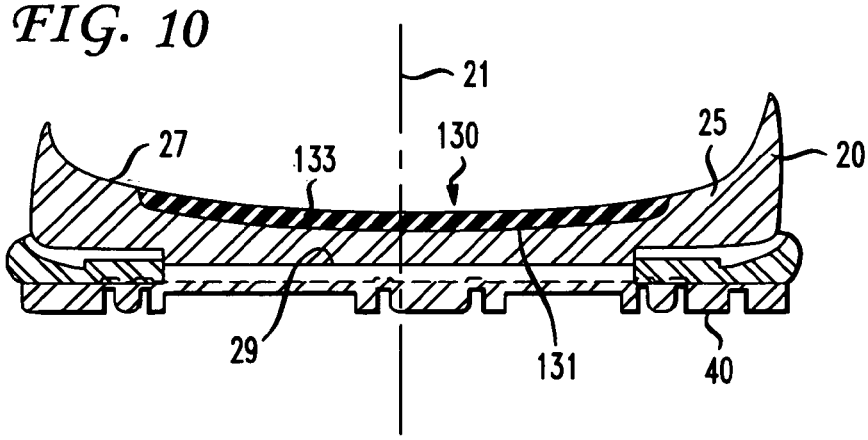
FIG. 10 is a section view of taken along line 10—10 of FIG. 4.
Figure 11:
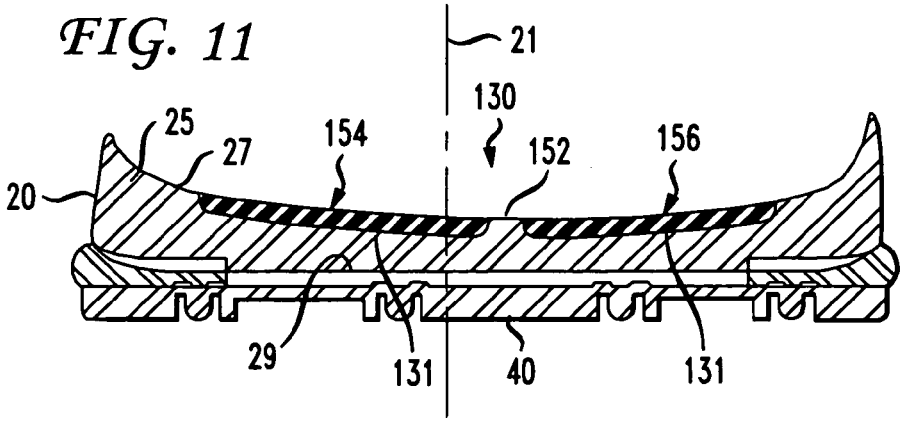
FIG. 11 is a section view of taken along line 11—11 of FIG. 4.

Referring to FIGS. 1, 4–5, and 8–11, sole 20 includes midsole plate 130 embedded within the midsole 25. The midsole plate 130 may be attached to the midsole material by an appropriate adhesive. As seen in FIGS. 8–10, midsole plate 130 is disposed inside the midsole 25 from the footbed side so that the plate 130 is recessed into the footbed of the midsole 25. The surfaces present on midsole 25 are a top footbed surface 27, and a bottom surface 29 for attaching to the outsole 40. Footbed surface 27, e.g., top of the midsole material, is configured to have a recessed portion which positively seats midsole plate 130 therein. This configuration allows the plate to be located at a short distance from the wearer foot for maximum efficiency of spring energy return. Footbed surface 27 may be contoured to provide a comfortable shape that supports the natural structure of the foot. In one exemplary construction shown in FIG. 11, the distance from the top surface 133 of midsole plate 130 to the bottom surface 29 of midsole 130 may range between 5.9 mm to 8.9 mm. Although, other dimensions are possible.

Midsole plate 130 is constructed of a lightweight plastic material. Midsole plate 130 can be formed by injection molding a plastic resin into a desired shape. If desired, the resin may be filled approximately 10% to 25% fiber material by volume to form a plastic resin composite. The plastic resin composite may be an enhanced resin having a filled fibrous composition, such as nylon, or glass. The resin may be a polyester or a similar material. In one arrangement, the fibers may be a chopped type mixed in the resin. Nevertheless, other materials and methods can form midsole plate 130.

Figure 6:
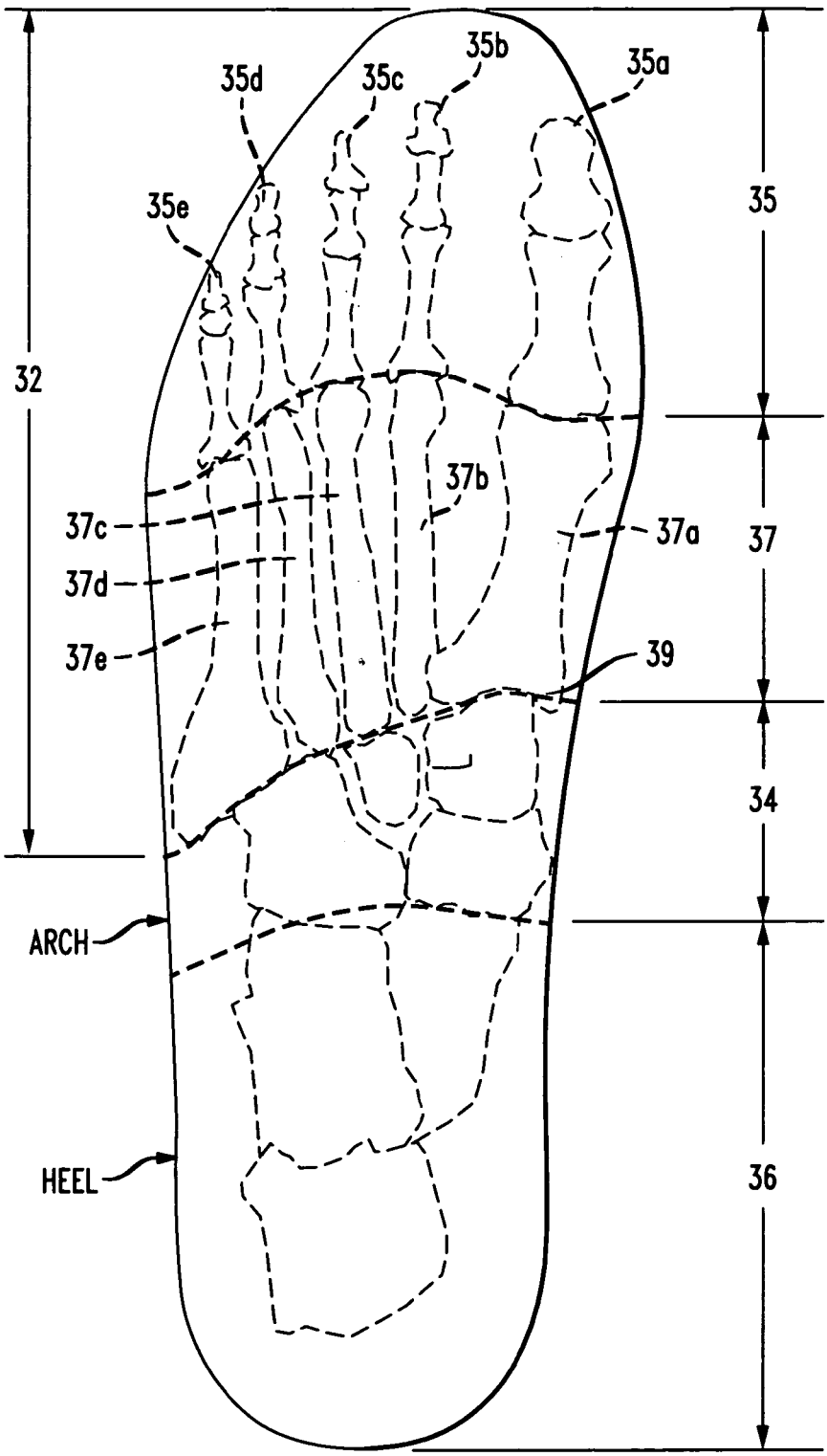
FIG. 6 is a schematic representation of an article of footwear illustrating a bottom plan view of the foot anatomy of a human body.

For a better understanding of the inventive article of footwear, FIG. 6 illustrates a bottom plan view (plantar view) of a schematic representation of a right foot anatomy of a human body. For ease of explanation regarding the preferred embodiment, the skeletal structure of a human foot includes three major divisions—the forefoot 32, the midfoot 34, and the rearfoot 36. The forefoot 32 includes forward phalanges interconnected to metatarsal bones. For ease of explanation to assist the reader, the rows and corresponding bones are labeled in FIG. 6. The phalanges bones 35*a*–35*e* are generally depicted with regard to region 35 and metatarsals bones 37*a*–37*e* are shown in region 37. As is known, the phalanges bones 35*a*–35*e* and metatarsals bones 37*a*–37*e* of the foot anatomy are disposed in five rows in which the medial side starts the first row across to the fifth row on the lateral side of the foot. The heads of the metatarsal bones have a generally bulbous structure. The midfoot generally includes the arch formed by several interconnecting bones and the transition between the midfoot 34 and forefoot 32 is generally known as the tarsometatarsal joint 39. The rearfoot includes the heel bone. One of ordinary skill in the art will recognize that the foot anatomy also includes interconnecting muscles and other tissues, which are not shown for clarity.

Figure 5:
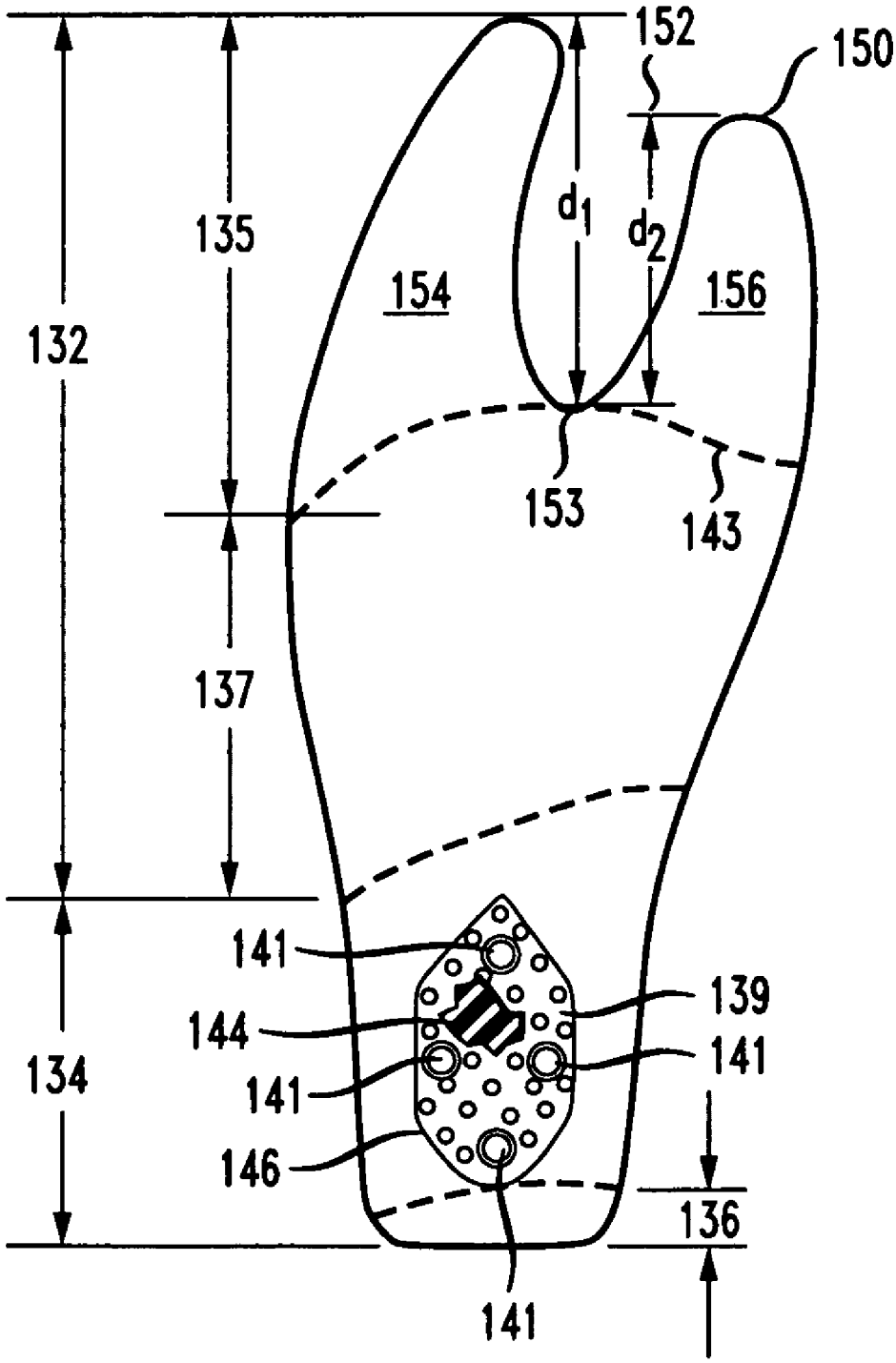
FIG. 5 is a schematic bottom plan view of a midsole plate according to one or more aspects of the present invention.
Figure 7:
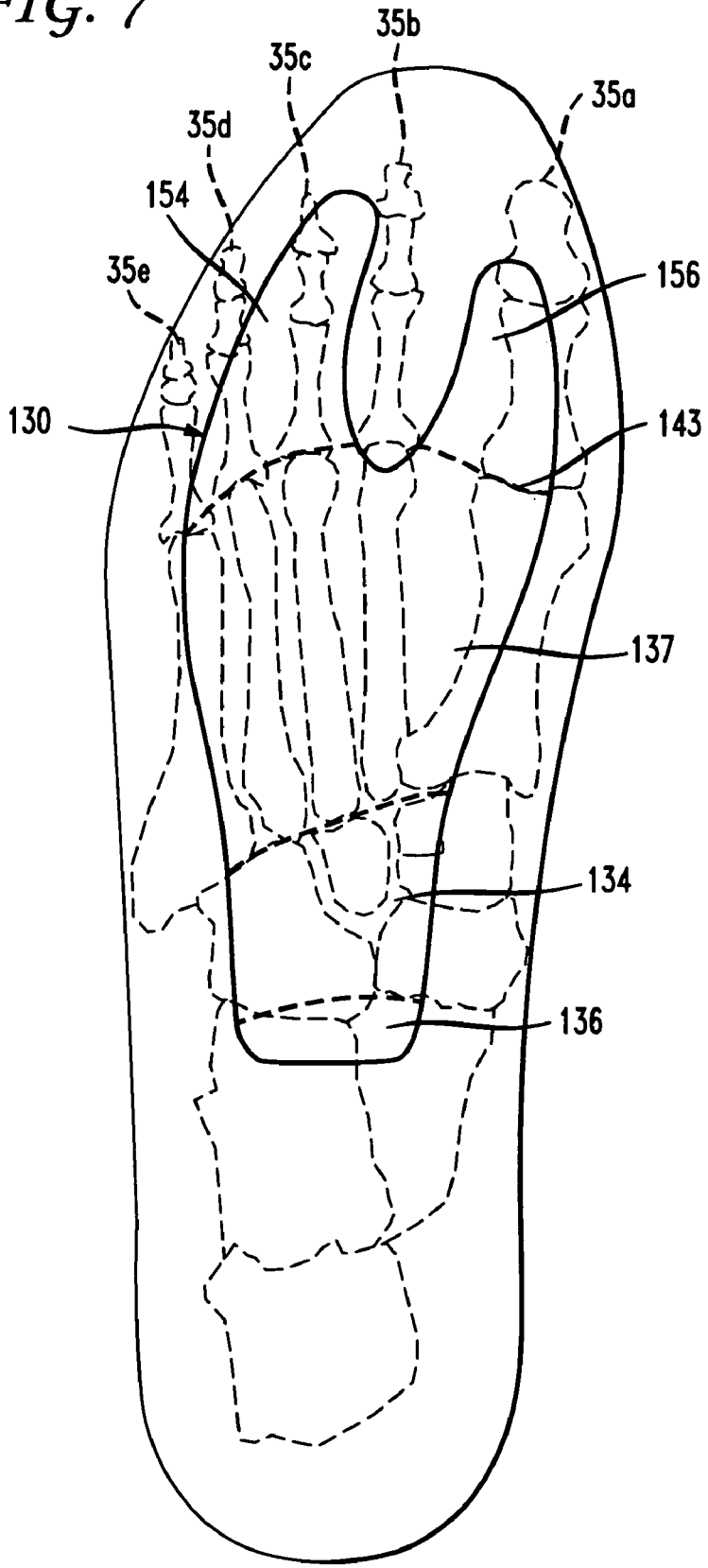
FIG. 7 is a schematic diagram of the article of footwear shown in FIG. 6 with a superimposition of a midsole plate arrangement corresponding to the anatomy of a human body.

With reference to FIGS. 5, and 7, in one arrangement, the midsole plate 130 includes portions that are defined by the regions of the foot anatomy superimposed thereon. The midsole plate 130 may be defined by a forefoot portion 132, and a midfoot portion 134 which are described and labeled by the respective portions substantially corresponding to the foot anatomy that would be superimposed thereto in a normal use condition. In another arrangement, midsole plate 130 may include a rearfoot portion 136 as well as the forefoot 132 and midfoot portion 134. In the forefoot portion 132, midsole plate 130 may be further defined by a forwardly disposed phalanx portion 135, and a metatarsal portion 137 which is disposed rearwardly of portion 135.

As seen in FIGS. 1, 5 and 7, midsole plate 130 in the forefoot portion 132 is bifurcated defining a fork structure 150. The fork structure 150 comprises two forwardly two distinct medial and lateral tines—a lateral fork member 154 and medial fork member 156. A forefoot flex portion 152 is disposed between the lateral fork member 154 and medial fork member 156. In one arrangement of the midsole plate 130, a transition region 143 between the phalanx portion 135 and metatarsal portion 137 is defined by the natural foot anatomy between the joint connection of the phalanges and metatarsal bones. In one configuration of the midsole plate 130, lateral fork member 154 extends forwardly from the transition region 143 to correspond to the third row 35*c* and fourth row 35*e* of the phalanges bones of a foot of a wearer. Similarly, the medial fork member 156 may extend forwardly from the transition region 143 to correspond to the first row 35*a* of phalanges bones of a foot of a wearer. In another arrangement, the lateral fork member 154 and medial fork member 156 may include part of the metatarsal portion 137. The fork structure 150 provides efficient medial-to-lateral transfer of the body weight so as to improve the forward thrust or propulsion of the athlete during ground engaging activities. Further, during cycling or pedal action, fork structure 150 allows for heel-to-toe stiffness supported by a pedal with respect to a heel-to-toe axis 102 during pedaling action. The heel-to-toe axis 102 is generally defined herein as the direction when a wearer of shoe 10 is moving in a forward motion.

With reference to FIG. 5, the forefoot flex portion 152 includes a voided portion of the midsole plate 130, which generally corresponds to the second phalange bones. That is, a portion of the midsole plate material has been removed to allow independent flexing of lateral fork member 154 and medial fork member 156. The independent flexing functionality improves toe-off performance of the wearer. The forefoot flex portion 152 includes a base 153 disposed at the lowest rear. In one construction, the depth d1 of the forefoot flex portion 152 is approximately 48 mm to 48.5 mm, as measured from the distal end of the lateral fork member 154 to the base 153. Further, the depth d2 of the forefoot flex portion 152 may range approximately 38 mm to 38.7 mm, as measured from the distal end of the medial fork member 156 to the base 153. Nevertheless, other dimensions are possible to include variations with foot size anatomy. In one configuration of shoe 10, lateral fork member 154 may be approximately 25%–30% longer than the medial fork member 156 as measured from the base 153. In yet another construction, the base 153 may be disposed at the corresponding second metatarsophalangeal joint, e.g., the joint connection for the second proximal phalanx and the second metatarsal bones. Nevertheless, other configurations and constructions are possible for the location of the base 153.

With reference to FIGS. 1, 5 and 7, lateral fork member 154 and medial fork member 156 can flex in a number of directions. In one aspect, members 154, 156 can each bend substantially in the heel-to-toe direction. In one arrangement of the midsole plate 130, the transition region 143 functions as a fulcrum for heel-to-toe pivoting thereabout of lateral fork member 154 and medial fork member 156. In another aspect, members 154, 156 are able to bend in a medial-to-lateral direction or lateral-to-medial direction. During a normal forward locomotion sequence, foot strike action occurs on the ball of the foot, e.g., at the first metatarsal head, and the first phalanges then continues in a medial-to-lateral direction towards the second through the fifth rows of the forefoot bones. Thus, the forefoot flex portion 152 allows for improved anatomical movement of the phalange bones by promoting uninhibited medial-to-lateral bending or lateral-to-medial bending.

As shown in FIGS. 8–11, in a preferred construction, mid-sole plate 130 may have a multi-stiffness configuration that has separate regions of different stiffness values that correspond to foot anatomy. In one arrangement, the midsole plate 130 includes a heel-to-toe stiffness characteristic in which the thickness of the plate is different in each of the forefoot portion 132 and midfoot portion 134. In another arrangement, the thickness is different in each of the phalanx portion 135 and metatarsal portion 137 of midsole plate 130. In one exemplary embodiment, the midsole plate 130 comprises a regional tapered thickness configuration, e.g., approximately 2.5 mm thick in the midfoot portion 136 to approximately 1.5 mm thickness between the intersection of the and phalanx portion 135 and metatarsal portion 137. Further, the tapered configuration extends to approximately 0.8 mm thickness at the end of the phalanx portion, e.g., the lateral fork member 154 and medial fork member 156. Thus, in this exemplary embodiment, a shoe is relatively stiff or firm in the midfoot portion 136; less stiff or more flexible in the metatarsal portion 137; and considerably flexible in the forefoot portion 135 relative to the midfoot portion 136 and the metatarsal portion 137. This inventive configuration advantageously allows the midsole plate to function in different ways and specific locations to facilitate running and cycling activities with the same shoe.

In one construction of the shoe 10, the stiffness in the midfoot portion 136 prevents excessive bending of the musculo-skeletal system in the arch of a foot of a wearer. This feature is advantageous for supporting efficient transfer of energy during cycling activities. The heel-to-toe stiffness provides for efficient pedaling for the effective transfer of energy from the lower limbs of a user into the pedal of a bicycle. This transfer of energy is provided by allowing the foot to apply a pedaling force generally perpendicular to the pedal during the down stroke. Therefore, pedaling energy is conserved through proper a pedaling angle resulting in an increased moment power on the crankshaft of the bicycle. It should be recognized that the main muscles at work in cycling are the quadriceps and hamstrings in the upper leg, and calf muscles. These muscles contract in a sequence that creates the pedaling action. Thus, in accordance with an aspect of the present invention, efficient transfer of energy reduces fatigue and increases endurance in at least one of the noted muscles.

With reference to FIGS. 1, 4–5, and 8–9, in one aspect, sole 20 enables air to enter from the outsole 40 to the interior of the upper 15 or air to escape therefrom so as to regulate the microclimate enveloping the foot of a wearer. In one construction, outsole 40 and midsole 25 include a voided portion 42, e.g., without material, so as to expose a portion of the midsole plate 130 to the exterior. As seen in FIG. 9, the voided portion 42 includes sidewalls 44 that extend to the bottom surface 131 of the midsole plate 130. This configuration forms an air pathway in the outsole 40 and midsole 25 for air communication within the upper 15. In a preferred construction, midsole plate 130 includes an exposed aeration region or ventilation portion 139 disposed in the rearfoot portion and within the voided area. Aeration region 139 advantageously receives ambient air to be communicated so as to provide breathability to ventilate the foot of the wearer. It should be recognized that air within the upper can be discharged by way of the aeration region 139. The breathability function is achieved in which the aeration region 139 includes a plurality of spaced perforations or apertures 141 which extend through the thickness of the midsole plate 130.

Solely by way of example without limiting scope, the perforations 141 may be a circular shape having a dimensional diameter of preferably 4 mm. Other dimensional diameters are possible such as a range of 3.5 mm to 4 mm. This allows for improved efficient air communication between the interior of the upper 15 and the ambient air. Nevertheless, perforations 141 can be a wide range of shapes and other configurations. In use, during a cycling downstroke, ambient air is somewhat pressurized to flow into and through the perforations 141 so that air enters the upper. Likewise, a cycling upstroke can provide a slight negative pressure to drawn air into the perforation 141. Hence, the aeration region is advantageous in such an athletic shoe because the region allows the foot to breathe thereby keeping the foot relatively dry during athletic activities. This is in contrast to a conventional athletic shoe used in hot weather where the temperature and moisture within the interior space of the upper may become elevated.

With reference to FIGS. 5 and 9, in one aspect, the void portion 42 of outsole 40 and midsole 25 allows for marketing of an article of footwear. In one construction, the bottom surface 131 of the midsole plate 130 may include indicium or various indicia 144 (schematically represented in FIG. 5) thereon, including but not limited to, one or more letters, numbers, symbols, and/or trademarks disposed within the void portion 42. In this configuration, the void portion 42 forms a pathway, which exposes the bottom surface 131 of the midsole plate 130. In another arrangement, a plurality of hemispherical projections 146 may be provided so that a customer can visualize the sole and its depth, including the midsole plate 130.

In one arrangement of the midsole plate 130, the resilient feature of a plastic plate in the metatarsal portion 137 provide synergetic benefits that provides an energy return to the foot during foot strike action. During pedaling actions, metatarsal portion 137 provides benefits of keep the foot generally perpendicular to the pedal during the downstroke. In one aspect, no footwear product is believed to currently offer the combination of properties of rigidity for cycling yet flexibility and cushioning for moderate running.

Figure 12:
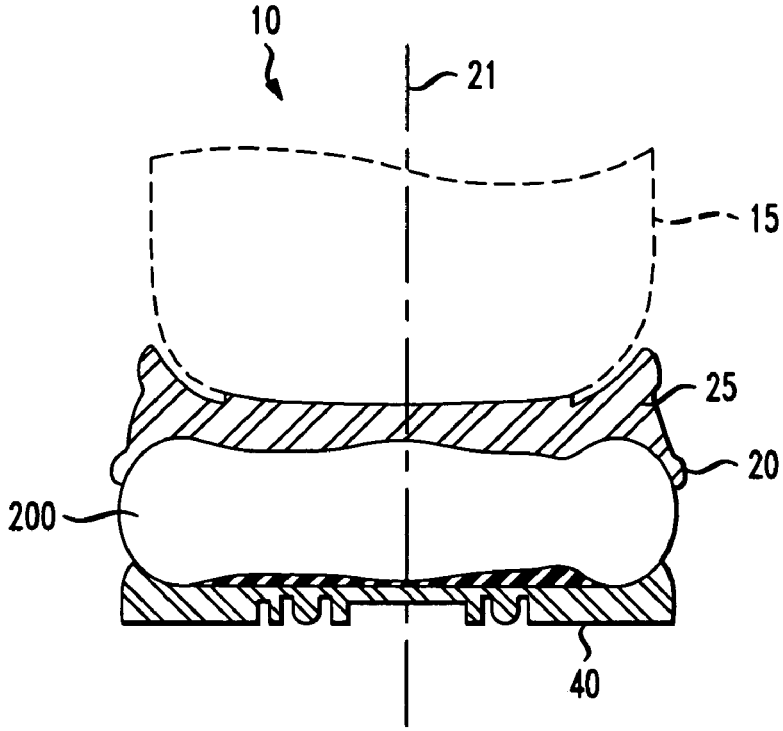
FIG. 12 is a section view of taken along line 12—12 of FIG. 4.
Figure 13:
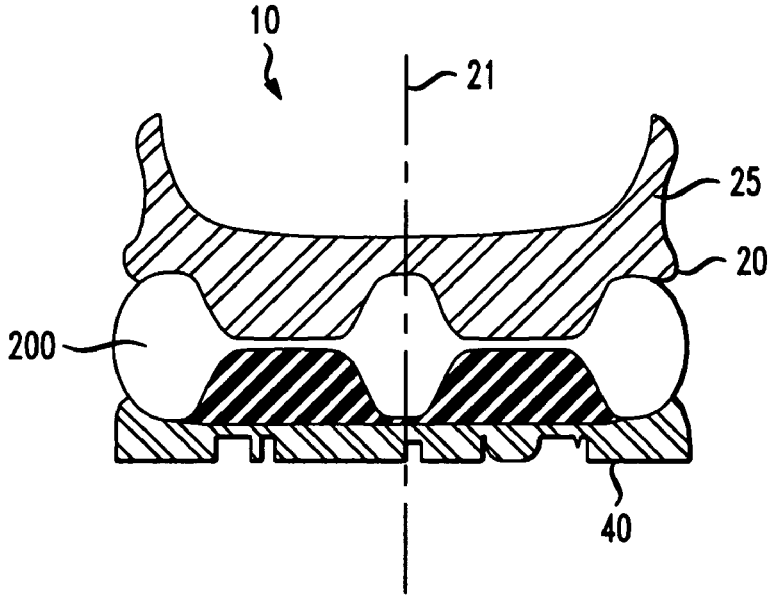
FIG. 13 is a section view of taken along line 13—13 of FIG. 4.

Cross section views of FIGS. 12 and 13 illustrate at least one configuration of the sole 20 in the rearfoot portion with a rear cushioning element, e.g., sealed gas-containing resilient bladder 200, which can be added into the midsole material to provide additional cushioning. In a preferred construction, a rear bladder 200 is positioned directly below the calcaneous in the heel to attenuate pressure points for running activities. Nevertheless, sole 20 may have other cushioning in the heel area. If desired, shoe 10 may include an insole or a sockliner (not shown) disposed inside and is preferably positioned between the foot of the wearer and the sole 20. A sockliner can provide additional cushioning and shock absorption of the shoe 10. The sockliner may be removable and replaceable from shoe 10. Optionally, a heel cup (not shown) may be provided to firmly support the heel of the foot of the wearer during athletic activity. Further, shoe 10 may include medial and lateral shanks (not shown) to address medial and lateral stability during foot strike action.

In operation, the previously described features can be implemented on a shoe with or without cleats extending from the sole. In one aspect, the features individually and/or in any combination, improve stability and propulsion, acceleration for the wearer of the shoe. In a cleated configuration, while the midsole plate 130 provides added rigidity at the same time it prevents potential cleat pressure from being transferred upward to the foot. As can be appreciated, midsole plate 130 advantageously reduces the undesirable stud pressure acting on the foot of the wearer at the bone structure. In a preferred construction, the reduction of stud pressure is achieved by eliminating direct transferred impact forces against the bottom of the bones. The thicker rearfoot midfoot portion 134 of midsole plate 130 attenuates the impact forces on acting on the foot of the wearer during foot strike action.

While the various features and aspects of shoe 10 work together to achieve the advantages previously described, it is recognized that individual features and sub-combinations of these features can be used to obtain some of the aforementioned advantages without the necessity to adopt all of these features. In one exemplary embodiment, an article of footwear 10 includes a sole 20 with a midsole 25. A midsole plate 130 includes a lateral fork member 154 and a medial fork member 156 configured to provide flexibility to the phalanges bones of a wearer during ground engaging actions. In another exemplary embodiment, the midsole plate 130 may include a plurality of perforations 141 configured for air communication within an upper 15 of the article of footwear 10. In yet another exemplary embodiment, the midsole plate 130 may include a phalanx portion 135, a metatarsal portion 137 and a midfoot portion 134 corresponding to a foot of a wearer. The phalanx portion 135, the metatarsal portion 137, and the midfoot portion 134 each may have a different stiffness value with respect to each other.

While the present invention has been described with reference to preferred and exemplary embodiments, it will be understood by those of ordinary skill in the art that various changes may be made and equivalents may be substituted for elements thereof without departing from the scope of the invention. In addition, many modifications may be made to adapt a particular situation or material to the teachings of the invention without departing from the scope thereof. Therefore, it is intended that the invention not be limited to the particular embodiments disclosed, but that the invention will include all embodiments falling within the scope of the appended claims.

What is claimed is:

1. An article of footwear, comprising:

an upper for holding a foot of a wearer; and a sole including an outsole and a midsole portion attached to the outsole; said midsole portion including a resilient material and a midsole plate being coupled to the resilient material, and the midsole plate having a two laterally disposed tines corresponding to a forefoot of a wearer when superimposed thereon, said tines defining a forked geometry; wherein the outsole and the midsole portion includes an elongated pathway surrounded by generally perpendicular sidewalls defined by the outsole and the midsole portion, the elongated pathway for air communication within an interior of the upper, the pathway having a distal end defining an air intake for receiving air at the outsole, the pathway having an air outlet opposing the air intake; and wherein the midsole plate includes a plurality of apertures configured for the air communication; the plurality of apertures of the midsole plate being connected to the elongated pathway via the air outlet.

2. The article of footwear of claim 1, in which said midsole plate includes a forefoot flexing portion being devoid of material, said forefoot flexing portion being disposed between said tines.

3. The article of footwear of claim 1, in which the midsole plate further comprises a midfoot portion corresponding to a foot of a wearer, the apertures and the pathway being disposed in the midfoot portion.

4. The article of footwear of claim 1, in which the midsole plate has a bottom surface including the plurality apertures extending therethrough, the bottom surface having a plurality of hemispherical projections surrounding the plurality of apertures.

5. The article of footwear of claim 1, in the which the midsole plate further comprises a phalanx portion, a metatarsal portion and a midfoot portion corresponding to a foot of a wearer, the phalanx portion, the metatarsal portion, and the midfoot portion of said midsole plate each having a different thickness with respect to each other.

6. The article of footwear of claim 5, in which the thickness of the midfoot portion of the midsole plate is greater than the respective thickness of the metatarsal portion and the phalanx portion.

7. The article of footwear of claim 5, in which the thickness of the metatarsal portion of the midsole plate is greater than the thickness of the phalanx portion.

8. An article of footwear, comprising:

an upper for holding a foot of a wearer;

a sole attached the upper: the sole including an outsole and a midsole; and a midsole plate attached to an upper surface of the midsole; the midsole plate having a plurality of perforations so that air is communicated from the outsole through midsole and the midsole plate into the upper; wherein an air communication pathway extends through the outsole and the midsole to encompass the plurality of perforations within a superimposed area on the midsole plate formed by the pathway; wherein the midsole plate further comprises two distinct forwardly disposed fork members configured to lie underneath a phalanx portion of a foot of a wearer and a predetermined metatarsal portion and a midfoot portion corresponding to a foot of a wearer, the metatarsal portion, and midfoot portion each having a different stiffness with respect to each other.

9. The article of footwear for claim 8, in which the midsole plate comprises a plastic material.

* * * * *